United States Patent [19]

Gauvry et al.

[11] 4,113,473

[45] Sep. 12, 1978

[54] PROCESS FOR OBTAINING NOVEL BLANKS FOR EXTRUSION BY IMPACT

[75] Inventors: Robert Gauvry, Paris; Robert Portalier, Ville D'Avray, both of France

[73] Assignee: Societe de Vente de l'Aluminium Pechiney, Paris, France

[21] Appl. No.: 778,233

[22] Filed: Mar. 16, 1977

[30] Foreign Application Priority Data

Mar. 19, 1976 [FR] France ..... 76 08611

[51] Int. Cl.[2] ..... C22C 1/06

[52] U.S. Cl. ..... 75/148; 75/143; 148/32; 164/120

[58] Field of Search ..... 75/148, 143, 68 R; 164/120, 123, 125; 148/32, 32.5

[56] References Cited

U.S. PATENT DOCUMENTS 1,940,922 12/1933 Sterner-Rainer ..... 75/148

*Primary Examiner*—R. Dean

*Attorney, Agent, or Firm*—McDougall, Hersh & Scott

[57] ABSTRACT

The invention relates to the manufacture of aluminum alloy blanks containing a large quantity of silicon and designed for extrusion by impact.

It consists in applying the method of casting with oriented cooling in the main patent to a hypereutectic silicon aluminum alloy which has previously been refined with phosphorus.

An even distribution of the remarkably fine primary silicon crystals is obtained in this way.

The invention is particularly applicable to the manufacture of linings for heat engines made of aluminum alloys.

5 Claims, No Drawings

PROCESS FOR OBTAINING NOVEL BLANKS FOR EXTRUSION BY IMPACT

The French Pat. No. 2,228,562 of the Societe de Vente de l'Aluminium Pechiney, corresponding to U.S. Pat. No. 3,955,262 issued on May 11, 1976 on an application entitled BLANKS FOR WIREDRAWING BY IMPACT, describes a process for obtaining blanks cast in aluminum or aluminum alloys intended for extrusion by impact.

This process consists in casting the molten metal in a mold having a high thermal conductivity, which is cooled through the base, and which has two insulated or heated detachable covers mounted on it, then in applying a moderate pressure of between 0.1 and 5 bars (preferably between 0.2 and 1 bar) once the blank has begun to solidify, in such a way that the metal from the sprue which is still molten may supply the draw holes of the blank as they are formed.

The applicant has discovered that by applying a casting process of this type to alloys which have a high silicon content and by combining this process with a silicon refining process known per se blanks which are particularly suitable for manufacturing linings for internal combustion engines by extrusion by impact may be obtained.

At present, there is a tendency to use silicon alloys and, in particular, hypereutectic alloys, that is those which contain more than 12% of silicon on average, for manufacturing these linings. Alloys of this type are particularly suitable for these uses for two main reasons:

1. Hypereutectic AlSi alloys have a lower coefficient of expansion than the other aluminum alloys and this is obviously of interest when dealing with items which move in relation to each other with a slight, controlled clearance, the temperature of these items developing during operation.

2. The presence of hard primary crystals of Si in a softer aluminum die, with or even without complementary surface treatment, makes these alloys particularly suitable for forming a slightly rough surface which promotes oil retention.

However, it should be noted that this eutectic composition is not strict and that, as a result of variations in the equilibrium, primary silicon crystals are always found in alloys which are very nearly eutectic, such as A-S13 or A-S12 UN and even in alloys of hypereutectic composition such as A-S10 UG.

The fact that the primary Si crystals must not be too large gives rise to a great problem in manufacturing those items made of alloys containing a large quantity of silicon or having a hypereutectic structure. The maximum size allowed is usually 100 microns. Now it is difficult to fulfill this requirement with cast items, particularly if they are rather large.

The process forming the subject of the invention enables linings which are derived from hypereutectic silicon alloys by extrusion by impact to be obtained by combining the following stages:

1. Refining the molten alloy by adding phosphorus. This may be added by any known method such as by adding red phosphorus either mixed with fluxes or not, by injecting $PCl_5$, by adding cuprophosphorus, ferrophosphorus, etc.

The phosphorous, doubtlessly be creating aluminum phosphorus particles which serve as nuclei for the primary silicon, increases the number of these nuclei and thus reduces the average size of the crystals.

2. Casting metal formed in this way by the process described in the Main Patent, that is by gravity in a mold which is forcibly cooled through the base, the upper cover or covers of which are insulated or heated so as to allow the molten metal from the sprue situated in the upper section to feed the plate being cast. Once solidification has begun, a moderate pressure of 0.1 to 5 bars and preferably of 0.2 to 1 bar is applied so that the molten metal from the sprue is forced into the draw holes of the blank and so that the heat supply and the circulating currents which are created in this way prevent basaltic structures from being formed and give the blank the desired even and symmetrical structure. The applicant has discovered that this method of directed cooling gives these hypereutectic silicon alloys other advantages apart from the properties of health, homogeneity, and isotropy described in the Main Patent. Combined with the action of the phosphorus, this method of casting helps to reduce the size of the grains of silicon and also ensures that these grains of primary silicon are evenly distributed in the mass of the blank.

3. Hot or cold extrusion by impact of the blanks cast in this way so as to obtain cylinders, the ends of which may merely be rejected.

It is noteworthy that during this operation there is no perceptible change in the distribution of the crystals of primary silicon, this distribution maintaining the evenness observed in the cast plates.

The following example facilitates understanding of the invention: a liquid bath of A-S17U4 alloy of the following composition Fe: 0.30%
Si: 17.00%
Cu: 4.00%
Ti: 0.02%

The molten metal is brought to a temperature of 840° C. and 0.30% of cuprophosphorus, corresponding to an addition of phosphorus of 0.1%, is added to it.

0.60% of magnesium is added and the plates are cast by the process described, in a mold, the bottom of which is formed by a block of graphite submerged in a metal item cooled by circulating water.

If the micrographic structure of the plates obtained in this way is examined, the primary silicon crystals are all seen to be substantially near to 20 microns in size.

The plates are 76mm in diameter and 28mm wide. These plates, which are preheated to about 400°, are introduced beneath the punch of a press for extrusion by impact, this punch being lubricated with a graphite-based lubricant.

The stress applied for extrusion is 240 tons. Cylinders with the following dimensions are obtained in this way:

external diameter: 75 mm
height: 115 mm
width: 4 mm the external and internal appearance of which is perfectly smooth and the height of which is the same at any point round the circumference (no ears).

A micrographic examination does not show a perceptible modification of the primary silicon crystals which the deformation has however aligned.

We claim:

1. A process for obtaining homogeneous and isotropic cast blanks for impact extrusion of silicon-aluminum alloys containing more than 12% of silicon comprising the steps of providing a liquid aluminum alloy with more than 12% of silicon, refining said alloy by adding from 0.01% to 0.1% of phosphorus, casting said alloy in a mold having a high thermal conductivity, cooling the mold from the base, applying, once solidification has begun, a pressure in the range of 0.1 to 5 bars.

2. A process as claimed in claim 1 which includes the step of minimizing heat loss from the top of the mold during solidification of the cast alloy.

3. A process as claimed in claim 2 in which the top of the mold is provided with a removable thermally insulated cover.

4. A process as claimed in claim 2 in which the heat loss from the top of the mold is minimized by heating the top of the mold.

5. A process for obtaining blanks as claimed in claim 1, in which the pressure is in the range of 0.2 to 1 bar.

* * * * *